US006520133B1

(12) United States Patent
Wenger et al.

(10) Patent No.: US 6,520,133 B1
(45) Date of Patent: Feb. 18, 2003

(54) RECIPROCATING ENGINE WITH ROCKER-ARM VALVE CONTROL

(75) Inventors: Urs Wenger, Langenthal (CH); Hans-Rudolf Jenni, Kaltacker (CH)

(73) Assignee: Wenko AG Burgdorf (CH)

( * ) Notice: Subject to any disclaimer, the term of this patent is extended or adjusted under 35 U.S.C. 154(b) by 0 days.

(21) Appl. No.: 09/762,784

(22) PCT Filed: Aug. 6, 1999

(86) PCT No.: PCT/EP99/05714

§ 371 (c)(1),
(2), (4) Date: Feb. 12, 2001

(87) PCT Pub. No.: WO00/09864

PCT Pub. Date: Feb. 24, 2000

(30) Foreign Application Priority Data

Aug. 11, 1998 (EP) ..... 98115057
Dec. 23, 1998 (EP) ..... 98811260

(51) Int. Cl.[7] ..... F01L 1/02

(52) U.S. Cl. ..... 123/90.27; 123/90.39; 123/193.4; 123/90.41

(58) Field of Search ..... 123/90.27, 90.39, 123/90.41, 90.44, 193.5, 193.3, 193.4

(56) References Cited

U.S. PATENT DOCUMENTS 3,967,601 A * 7/1976 Heberle ..... 123/90.4
5,095,861 A * 3/1992 Dove ..... 123/90.39
5,339,778 A * 8/1994 Reckzugel ..... 123/193.5
5,421,298 A * 6/1995 Ming ..... 123/193.5
5,605,077 A 2/1997 Tsunoda et al.
5,704,315 A * 1/1998 Tsuchida ..... 123/90.16

FOREIGN PATENT DOCUMENTS

| | | | |
|---|---|---|---|
| DE | 801241 | 12/1950 | |
| DE | 3630128 | 3/1988 | |
| DE | 003637199 A1 * | 5/1988 | ..... 123/90.39 |
| DE | 4223325 | 10/1993 | |
| FR | 002601718 A1 * | 1/1988 | ..... 123/90.39 |
| GB | 2157770 | 10/1985 | |
| JP | 363018106 A * | 1/1988 | ..... 123/90.17 |
| JP | 01-262327 | 10/1989 | |
| JP | 05-214917 | 8/1993 | |

* cited by examiner

*Primary Examiner*—Thomas Denion
*Assistant Examiner*—Jaime Corrigan
(74) *Attorney, Agent, or Firm*—Ostrolenk, Faber, Gerb & Soffen, LLP

(57) ABSTRACT

The reciprocating engine comprises a rocker valve gear, pistons which are fastened to a connecting rod and connected by crankshaft journals to a crankshaft, a balancer, and a camshaft which is driven by the crankshaft and in turn actuates rockers, the mentioned elements being arranged in a crankcase having a cylinder head and cylinder head cover. The cylinder head is provided with integrally cast or screwed-on receivers serving for the attachment of the hollow camshaft without requiring separately fastened bearing blocks. Correspondingly, the cylinder-head comprises further integrally cast or screwed-on receivers which serve for the attachment of the hollow rockers without requiring separately fastened bearing blocks.

2 Claims, 8 Drawing Sheets

RECIPROCATING ENGINE WITH ROCKER-ARM VALVE CONTROL

The present invention describes a reciprocating engine with rocker valve gear according to the preamble of the independent claims. By way of example, the invention will be explained in more detail with reference to a 2-cylinder in-line engine, but it applies to reciprocating engines having any desired number of cylinders.

Engines having different kinds of valve gears are known in the art, e.g. according to FIG. 1, which schematically shows four different valve gears as described in the book *Kraftfahrtechnisches Taschenbuch Bosch*, published by VDI-Verlag, 19th edition, for example. One possible embodiment is the rocker valve gear shown in FIG. 1, drawing 3. Today, this kind of valve gear is used especially in engines where low friction and a low construction height are primary requirement s. The drawbacks of this design are substantially greater complications in machining and assembly of the valve gear, costly maintenance, and an increased space consumption in the longitudinal direction of the cylinders.

U.S. Pat. No. 5,605,077 discloses a reciprocating engine where the diameter of the bearings receiving the camshaft increases in the mounting direction, so as to facilitate the insertion of the camshaft. However, the precise machining of these bearing holes with different diameters is very costly. The reference also discloses that the rockers are supported at the same bearing locations, the bearings being enlarged at the locations of the rocker bores. Due to the fact that the rocker bores are disposed in the cylinder block, the assembly of the rockers can only take place in the cylinder head.

On the background of this prior art, it is the object of the present invention to eliminate the drawbacks of anterior rocker valve gears with respect to substantially greater complications in machining and assembly of the camshaft and of the rockers, costly maintenance, and increased space consumption in the longitudinal direction of the cylinders. An engine with rocker valve gear of this kind is defined in the independent claims. Further advantages and embodiments are described in the dependent claims.

The invention is described in more detail hereinafter with reference to a drawing of solutions of the prior art and with reference to an exemplary embodiment of a 2-cylinder in-line engine.

FIG. 1 schematically shows four possible valve gears;

FIG. 2 schematically shows a lateral view of a valve gear of an engine of the invention;

Figure 6:
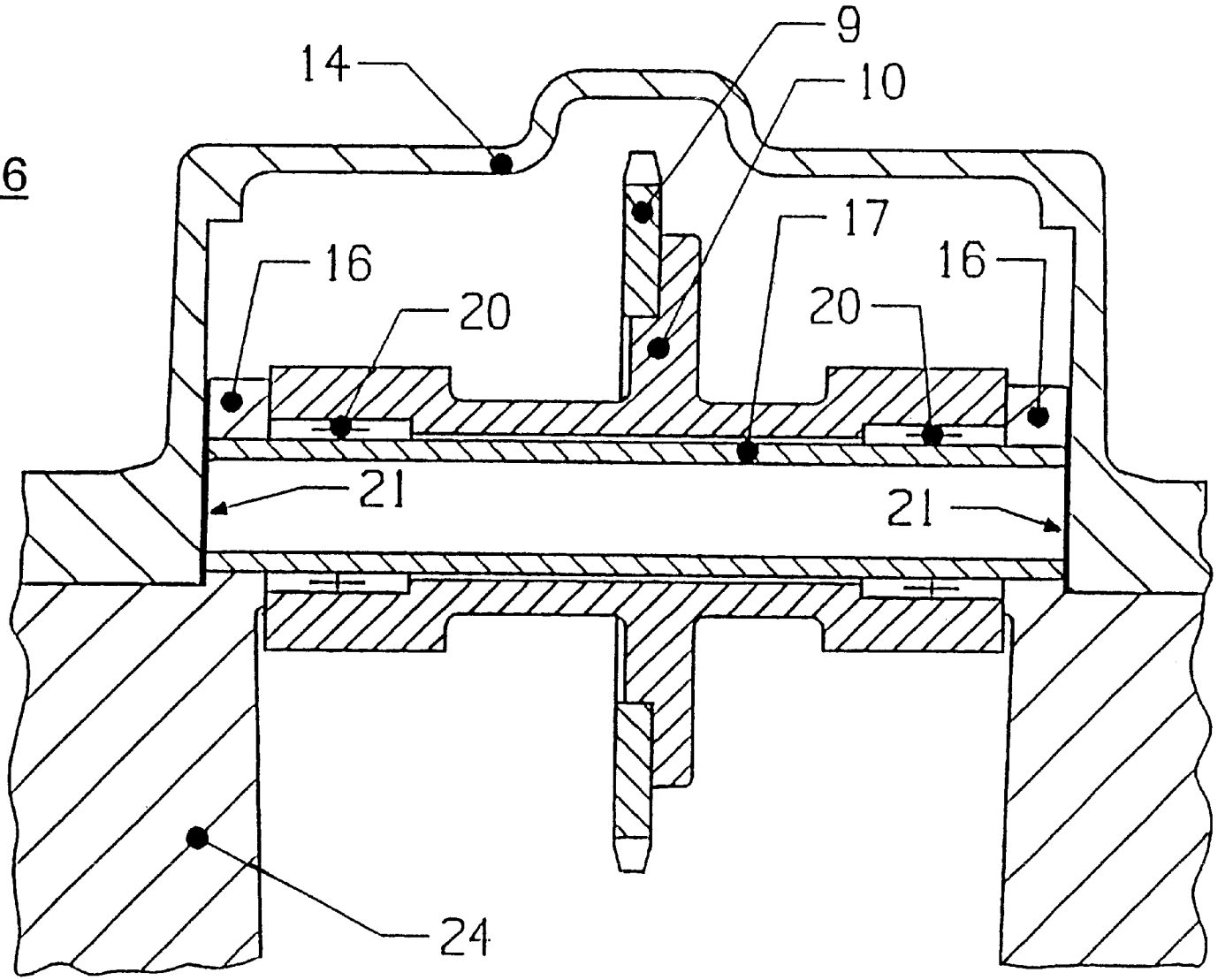
Figure 7:
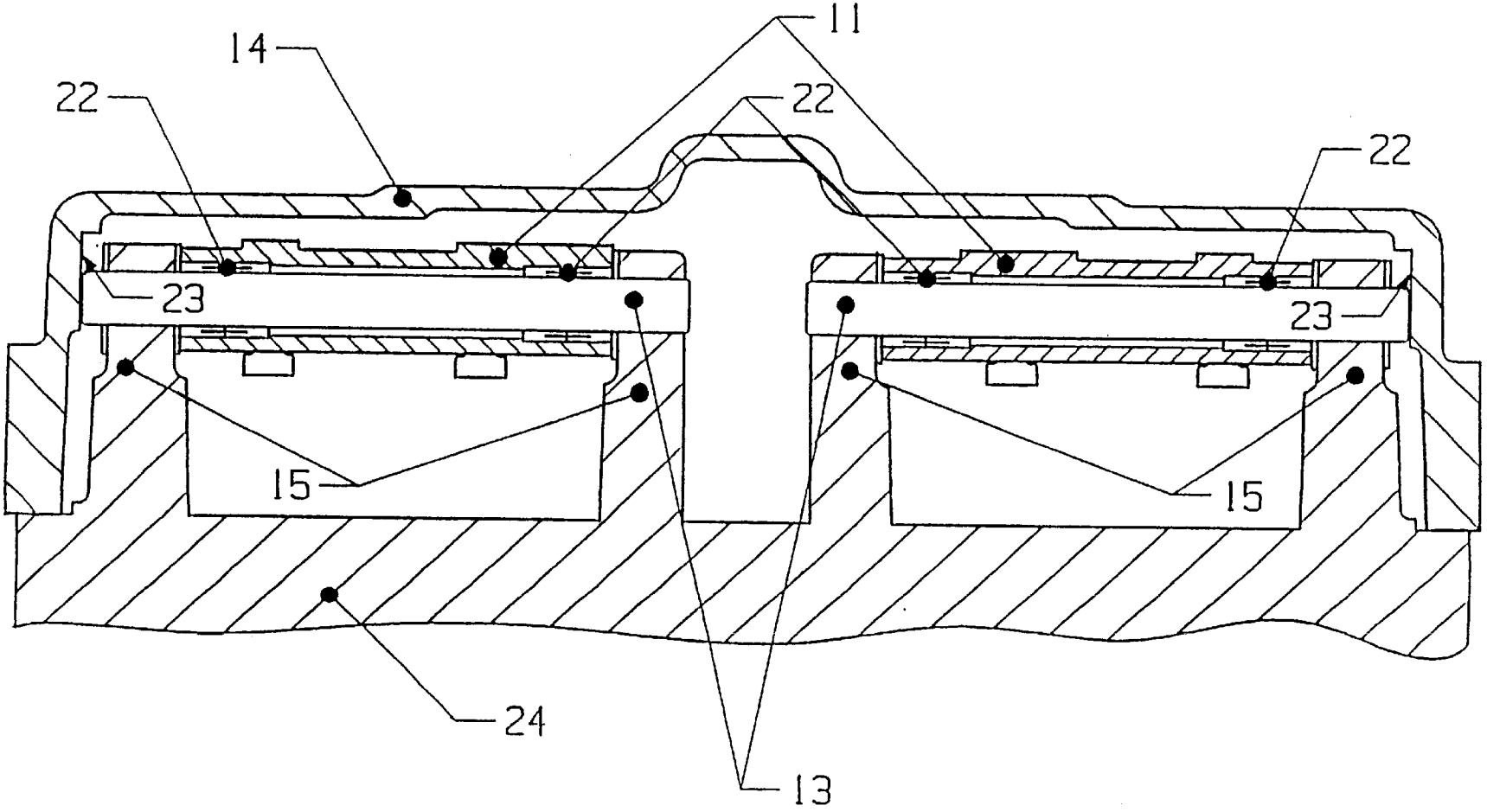
Figure 8:
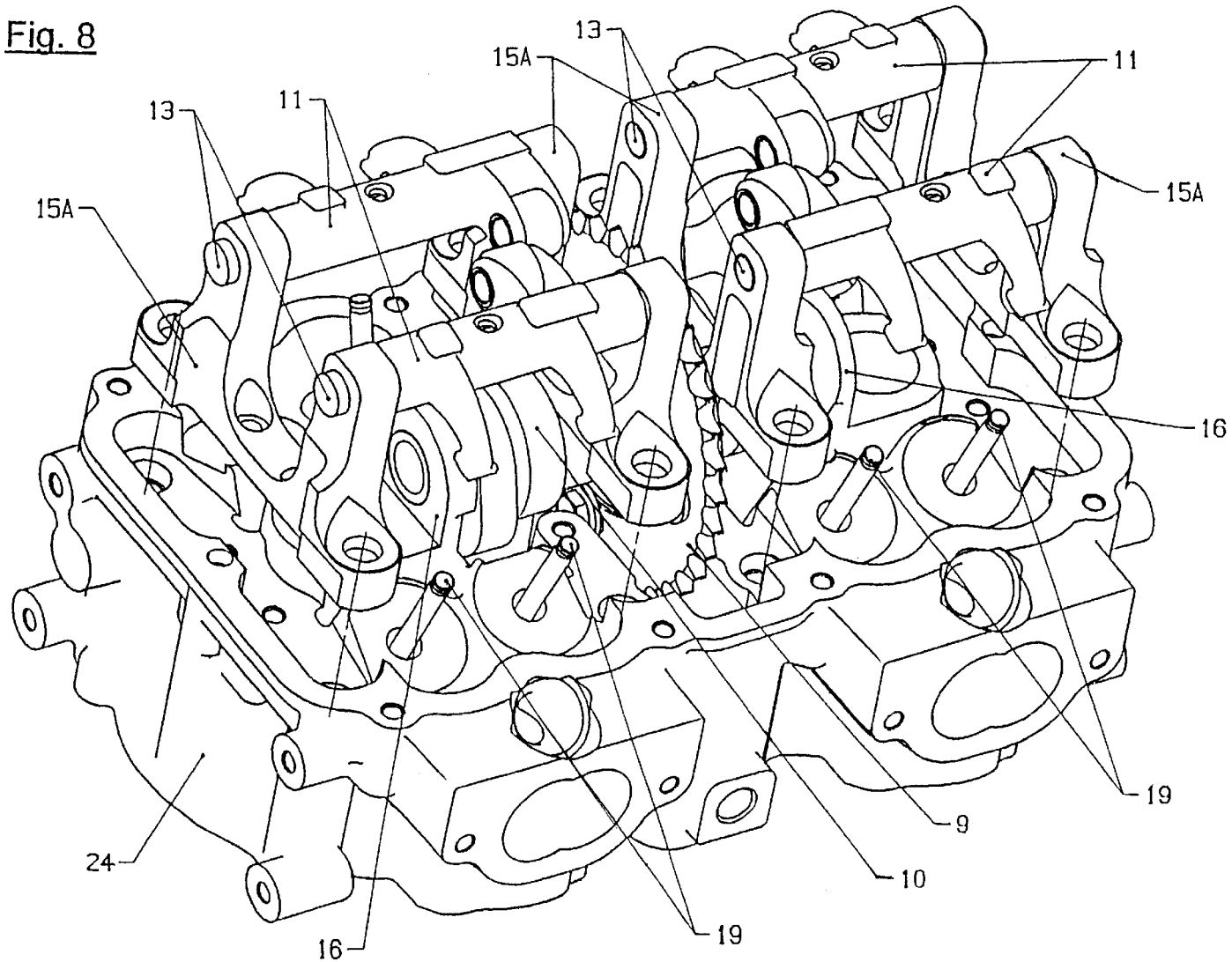

FIG. 6 schematically shows a first cross-section of the cylinder head enclosure of the invention;

FIG. 7 shows another cross-section of the cylinder head enclosure of the invention; and FIG. 8 shows a perspective view of a variant of the embodiment of FIG. 7.

FIGS. 2 to 5 schematically s how parts of the driving mechanism of a reciprocating engine of the invention, with pistons 1, of which only one is shown, and which are fastened to connecting rods 2 and connected by crankshaft journals 3 to crankshaft 4. Further shown are a balancer 5 comprising chain wheel 5K, a chain wheel 6 which is directly connected to the crankshaft, as well as a chain tensions wheel 7 which drives the camshaft chain wheel 9, thus allowing camshaft 10 to be rotated and to actuate rockers 11, which move the schematically indicated valves 19 along valve axis 12.

An internal combustion engine of the reciprocating type as represented in the exemplary embodiment by a so-called in-line engine comprises two parallel, non-represented cylinders in which the pistons 1 and 2 reciprocate. The crankshaft 4 arranged below the cylinders comprises two crankshaft journals 3 on each of which a respective connecting rod 2 is journalled. Each one of the connecting rods is connected to a piston 1 reciprocating in the respective cylinder. A camshaft 10 is arranged on top of the cylinders. The cams 18 of camshaft 10 actuate rockers 11 which cooperate with the corresponding valves 19.

Camshaft 10 is driven by a camshaft chain wheel 9 which is arranged between the pairs of cams for the individual cylinders. In the exemplary embodiment, this camshaft chain wheel is disposed in the center of the camshaft, but in other embodiments, it might be offset from the center.

Camshaft 10 is driven by crankshaft 4 through control chain 8 via camshaft chain wheel 9, chain tensions wheel 7, counter-rotating balancer 5 with balancer chain wheel 5K, and crankshaft chain wheel 6. Another possible embodiment of the camshaft driving mechanism comprises a toothed belt and toothed wheels instead of a chain and chain wheels.

The sectional views of FIGS. 6 and 7 illustrate the assembly of camshaft 10 and of rockers 11 directly into integrally cast receivers 15 and 16 of cylinder head 24. This offers the advantage of a very simple machining and a very simple assembly of the camshaft and the rockers. FIGS. 6 and 7 only show portions of cylinder head 24 and cylinder head cover 14, in which all the described elements are arranged.

The assembly will be explained and the advantages will be pointed out in more detail herebelow with reference to camshaft 10. According to the present invention, the integrally cast receivers 16 in cylinder head 24 for camshaft 10, which is a hollow shaft, only need to be bored to the desired shaft dimension, such that camshaft 10 provided with internal roller bearings 20 can be placed between receivers 16, and camshaft axle 17, which serves as a mounting shaft, can be pushed in. Cylinder head cover 14 with correspondingly machined lateral surfaces 21 serves for laterally maintaining camshaft axle 17.

Correspondingly, this also applies to rockers 11, which are also in the form of hollow shafts with roller bearings 22, and which are placed according to FIG. 7 between receivers 15, whereupon rocker axles 13, which serve as mounting shafts, are pushed in and are maintained by lateral surfaces 23 of cylinder head cover 14.

Thus, one advantage of the invention is a very simple machining of the valve gear and a very simple assembly of the camshaft and of the rockers. Another advantage of the invention is the use of roller bearings for the camshaft and the rockers, whereby very low friction losses are possible and no pressure lubrication is necessary.

Another important advantage of the invention is that no additional fastening of bearing blocks by screws or by other means is necessary. Due to the special design of the cylinder head cover, the latter needs no bearings. Furthermore, there are no interrupted sealing surfaces between the cylinder head cover and the cylinder head, and a very simple sealing of the spark plug bore is possible. Due to the possibility of using the cylinder head cover for the fastening of axles 13 and 17, no further securing of the camshaft and of the rockers is necessary. The invention also allows a significant simplification of servicing operations such as valve clearance control and adjustment, and the camshaft and rockers are extremely easy to replace.

FIG. 8 shows a design variant of the receivers, more particularly of the rocker shaft receivers, the cylinder head being illustrated in a perspective view. It has been found that cast receivers for the rocker shafts fail to meet the requirements of certain models and under high stresses. In such cases, in the embodiment of FIG. 8, the cast receivers 15 according to FIG. 7 may be replaced by steel receivers 15A which are directly screwed to cylinder head 24 in pairs. The other advantages of the cast receivers are entirely conserved, and the assembly of the rocker shafts is effected in the same way.

If necessary, the cast camshaft receivers 16 may also be replaced by prefabricated receivers which are subsequently screwed to the cylinder head.

Furthermore, it has been found that the use of receivers, either of cast receivers or of prefabricated and screwed ones, offers substantial advantages and economies also for the mounting of camshafts or rockers of the prior art. In analogy, it has been found that the use of hollow shafts for the mounting of camshafts and rockers offers advantages also in arrangements of the prior art.

Figure 1:
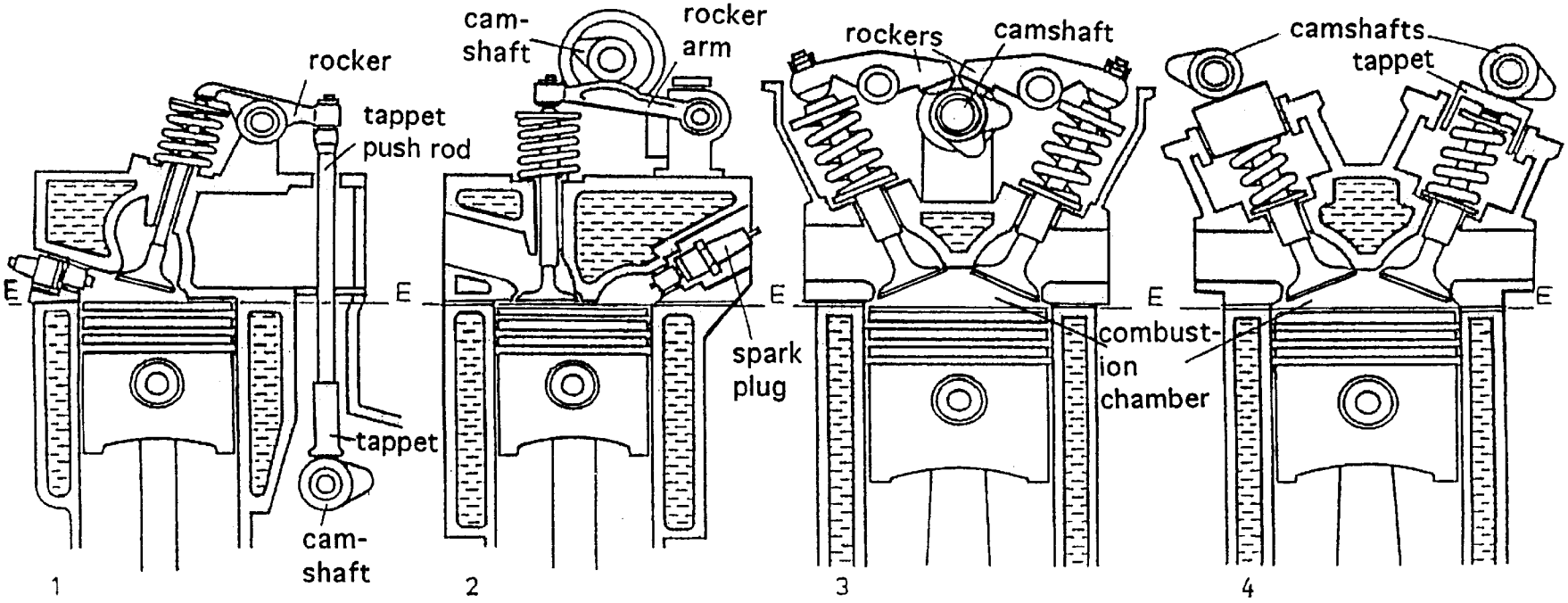
Figure 2:
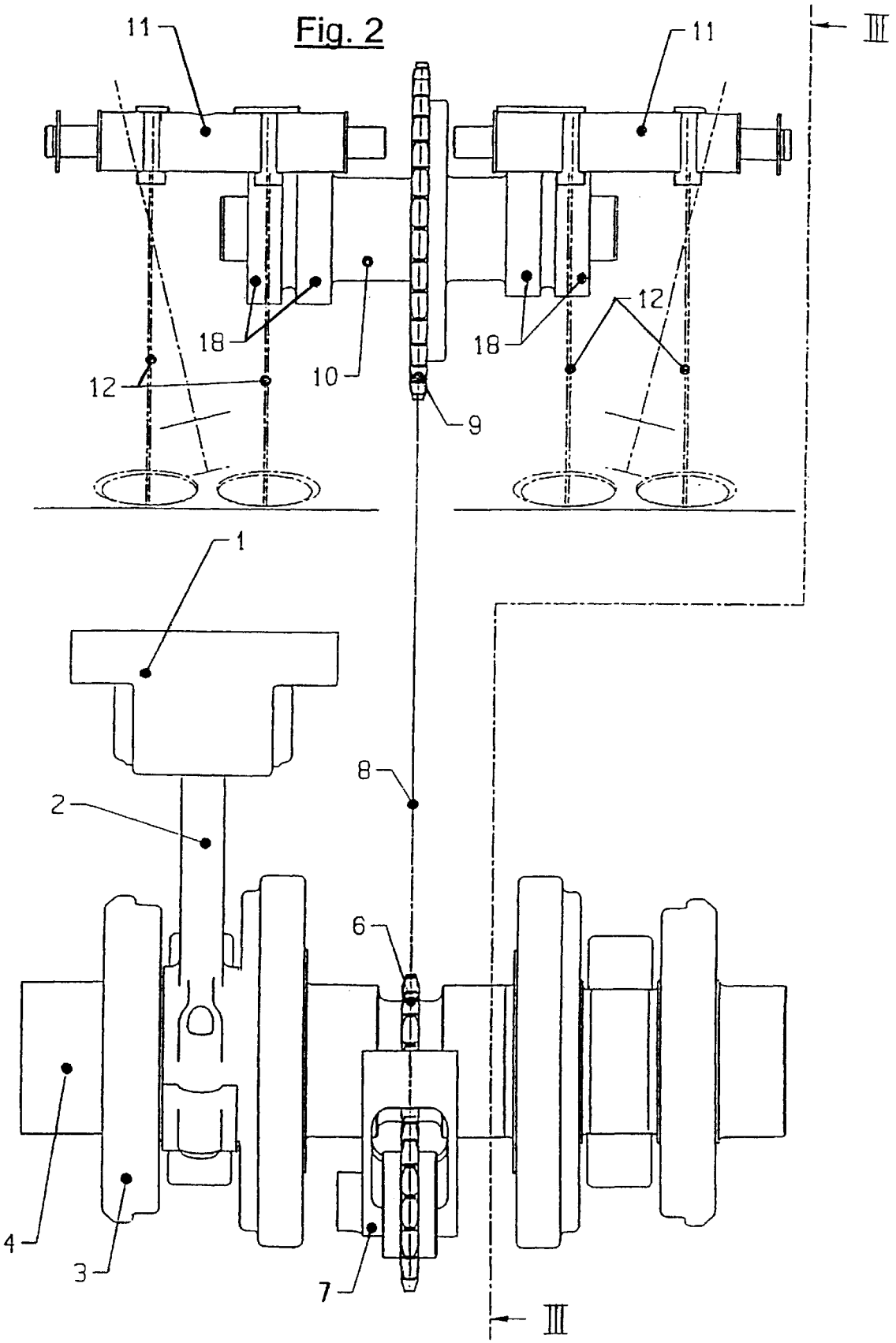
Figure 3:
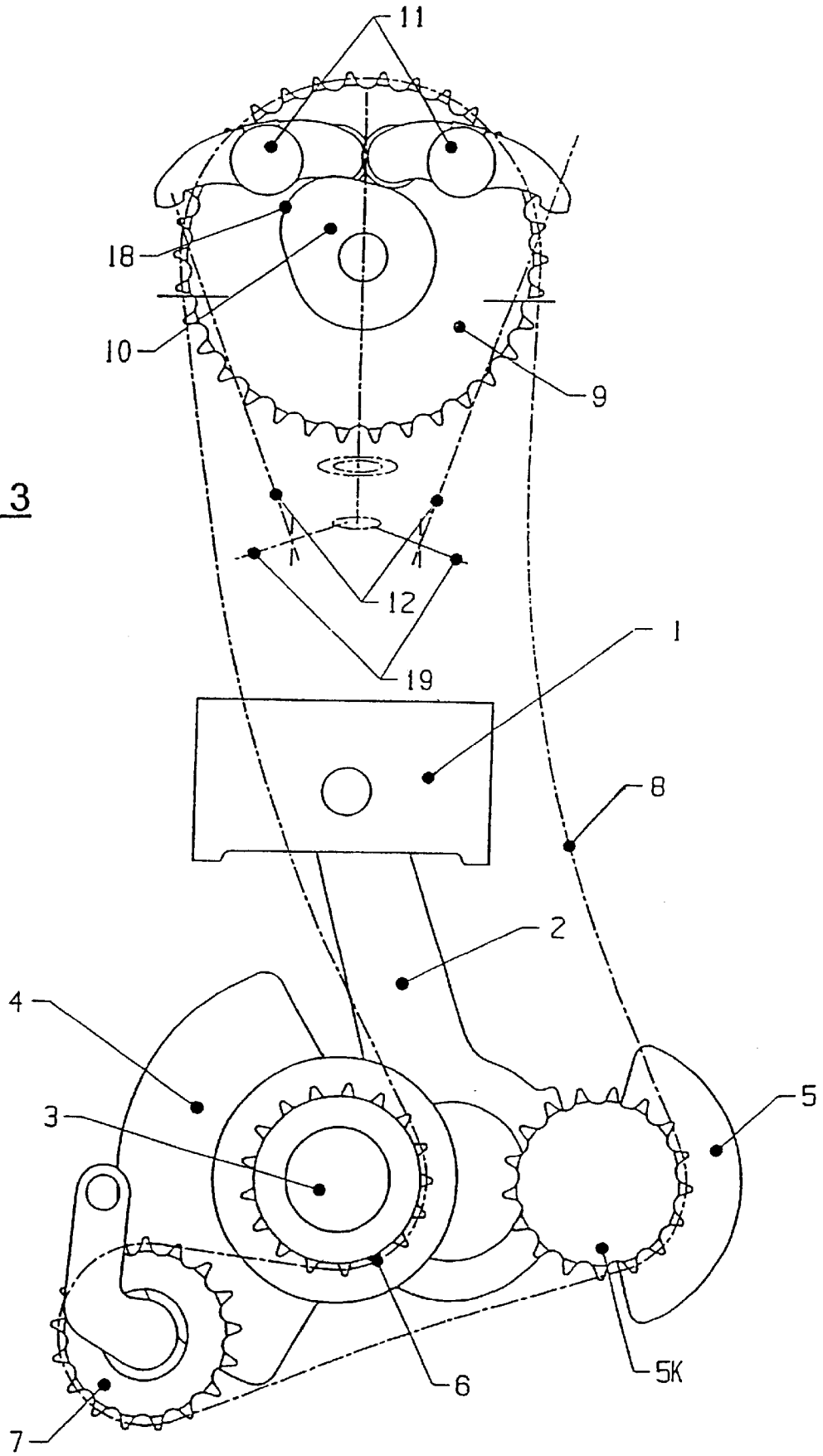
FIG. 3 shows a sectional view according to line III—III in FIG. 2.
Figure 4:
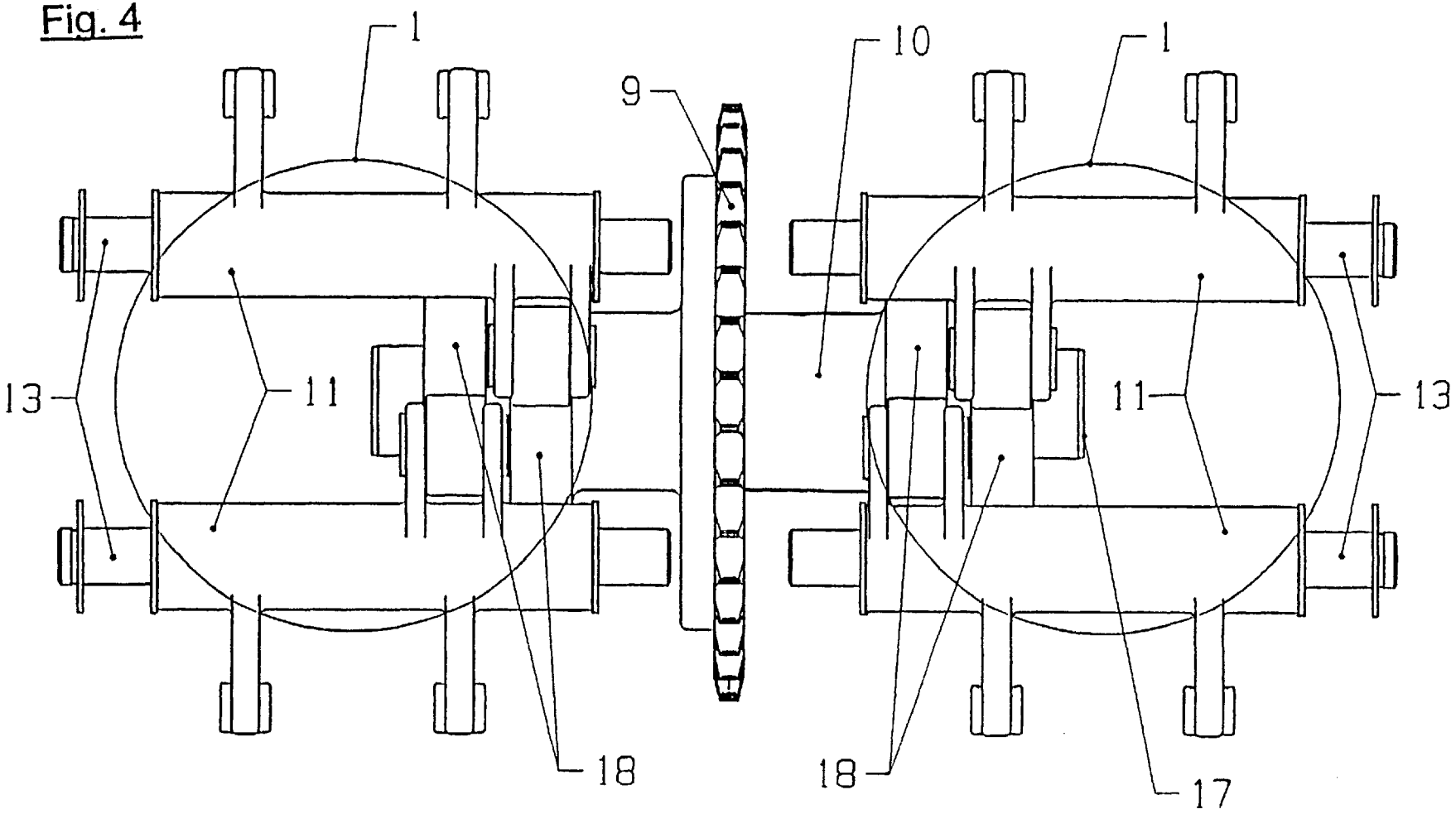
FIG. 4 shows the rocker arrangement of FIGS. 2 and 3 in a top view.
Figure 5:
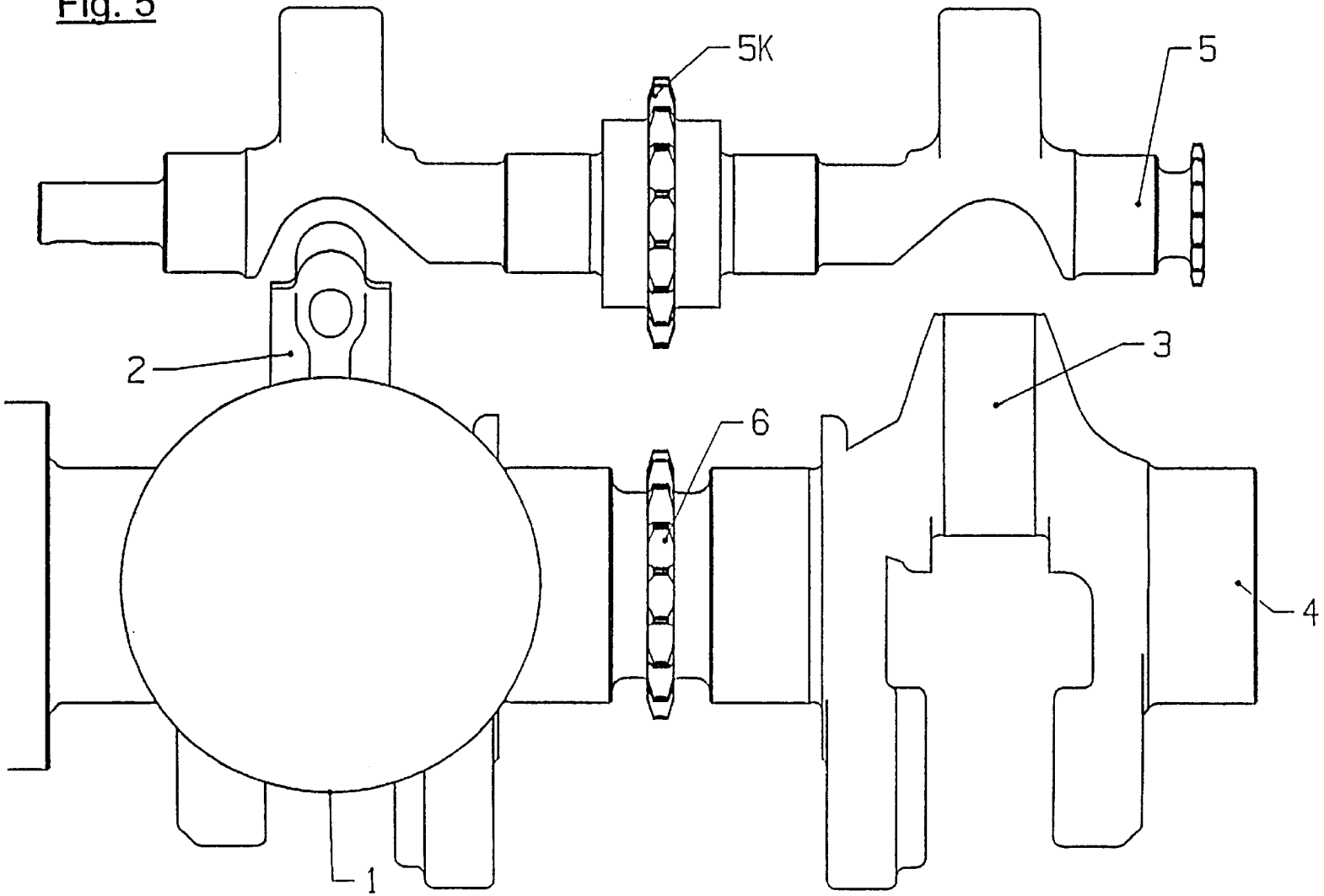
FIG. 5 shows a top view of the crankshaft and the balancer of FIG. 2.

Especially in FIG. 3, it appears that camshaft 10, chain tensioning wheel 7, and counter-rotating balancer 5 with chain wheel 5K are driven by crankshaft 4 through a single chain 8 arranged in line with the crankshaft and its chain wheel 6. This offers the advantage that the very compact design allows a very slim construction, and that additional components such as intermediate shafts may be omitted. Also, due to the location of chain tensions wheel 7, this arrangement of the chain allows a reversed direction of rotation of balancer 5 and a sufficient angle of contact of all driving and driven components. Chain tensions wheel 7 is arranged in line with crankshaft chain wheel 6 in such a manner that both a sufficient angle of contact for all shafts and a reversed direction of rotation of balancer 5 are obtained. For reduced friction, chain tensions wheel 7 may comprise roller bearings while being sufficiently lubricated by splash oil of the chain.

This feature of the invention also contributes to a very simple and compact design of the valve gear. Instead of a chain drive, the invention may be embodied with toothed belts. In this case, the chain wheels will be replaced by toothed belt wheels.

What is claimed is:

1. A reciprocating engine having at least one cylinder and a rocker valve gear, comprising:

a piston for each said cylinder, said piston is fastened to a connecting rod and connected by a crankshaft journal to a crankshaft, a balancer, and a camshaft, said camshaft is driven by said crankshaft and in turn actuates rockers; and a crankcase having a cylinder head and cylinder head cover, wherein said cylinder head has receivers, said receivers are directly fastened in said cylinder head and receive a nonrotating camshaft axle.

2. A reciprocating engine having at least one cylinder and a rocker valve gear, comprising:

a piston for each said cylinder, said piston is fastened to a connecting rod and connected by crankshaft journals to a crankshaft, a balancer, and a camshaft, said camshaft is driven by said crankshaft and in turn actuates rockers; and a cylinder head and cylinder head cover, wherein said cylinder head is provided with receivers prefabricated from steel, said receivers are screwed into said cylinder head and receive nonrotating rocker lever axles.

* * * * *